United States Patent [19]

Bohlmann et al.

[11] 4,420,063

[45] Dec. 13, 1983

[54] ARRANGEMENT FOR REDUCING THE SUCTION AND/OR EXHAUST NOISES FOR RAPID SPEED COMBUSTION MACHINES

[75] Inventors: Volker Bohlmann, Hamburg; Norbert Kania, Hanover, both of Fed. Rep. of Germany

[73] Assignee: Sachs-Dolmar GmbH, Hamburg, Fed. Rep. of Germany

[21] Appl. No.: 374,526

[22] Filed: May 3, 1982

Related U.S. Application Data

[63] Continuation of Ser. No. 81,333, Oct. 3, 1979, abandoned.

[30] Foreign Application Priority Data

| | | | |
|---|---|---|---|
| Oct. 3, 1978 | [DE] | Fed. Rep. of Germany | 7829489 |
| Oct. 4, 1978 | [DE] | Fed. Rep. of Germany | 7829599 |
| Jul. 28, 1979 | [DE] | Fed. Rep. of Germany | 2930668 |

[51] Int. Cl.[3] ..... F02M 35/12; F01N 1/00

[52] U.S. Cl. ..... 181/229; 181/255

[58] Field of Search ..... 181/227, 229–230, 181/247, 250, 255, 266, 272–273, 275–276; 55/276

[56] References Cited

U.S. PATENT DOCUMENTS

| | | | |
|---|---|---|---|
| 2,765,044 | 10/1956 | Hatte | 181/275 |
| 4,109,751 | 8/1978 | Kabele | 181/255 X |

FOREIGN PATENT DOCUMENTS

| | | | |
|---|---|---|---|
| 735737 | 4/1943 | Fed. Rep. of Germany | 181/255 |

*Primary Examiner*—Thomas H. Tarcza

*Attorney, Agent, or Firm*—Toren, McGeady and Stanger

[57] ABSTRACT

Apparatus for reducing intake noise is characterized in that the casing is provided with an air intake connection whose one end extends into the inner area of the casing and with a carburetor connection whose one end extends into the inner area of the casing and whose inlet faces the outlet of the air intake connection located in the inner area of the casing accompanied by the formation of a space having a width approximately corresponding to half the diameter of the connection which has the same diameter.

4 Claims, 6 Drawing Figures

Figure 1:
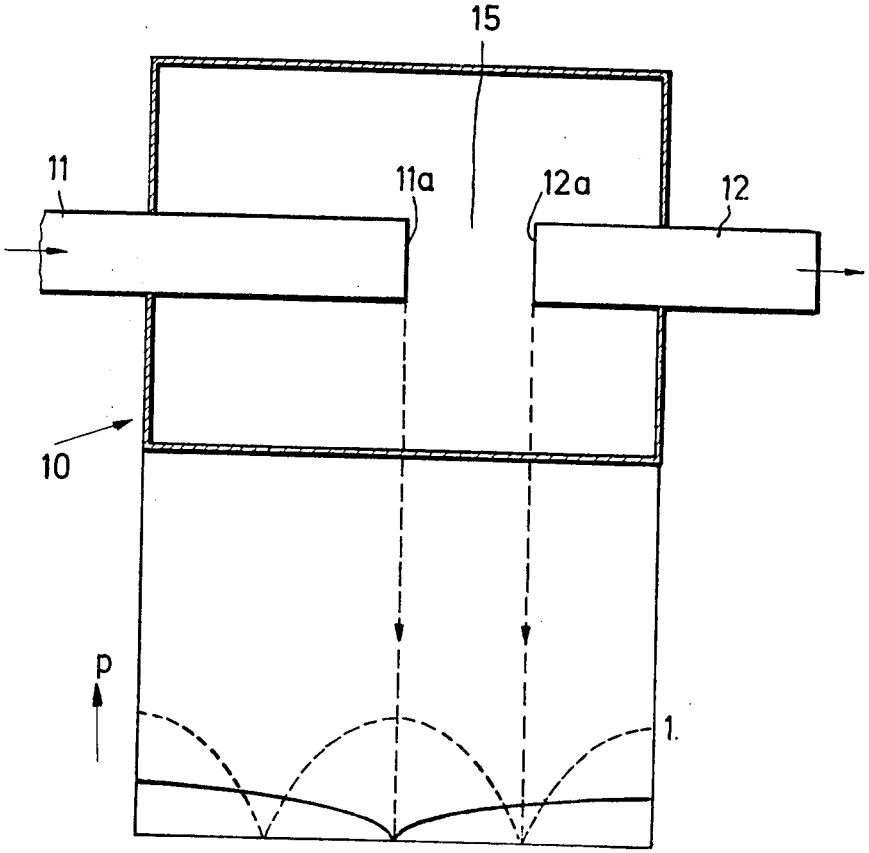

ARRANGEMENT FOR REDUCING THE SUCTION AND/OR EXHAUST NOISES FOR RAPID SPEED COMBUSTION MACHINES

This is a continuation of application Ser. No. 81,333 filed on Oct 3, 1979 now abandoned.

The invention relates to an apparatus for reducing the intake and/or exhaust noise of high speed internal combustion engines, particularly for internal combustion engine-driven chain saws, lawn mowers and light motor cycles, comprising a closed, box-like single and multi-chamber casing.

In a very small number of cases, sound-damping devices are used on the intake side of the drive units for tree saws, lawn mowers and light motor cycles. In the known drive units on the exhaust side, single chamber silencers are used, which from the noise standpoint are not synchronized in any recognizable systematic manner. This noise damping is often achieved by fitting diaphragms and partial cavities interconnected by large, but not optimised pipes. It is also conventional practice to use long, bulky reflections silencers, comprising a diffuser, long counter-cones, diaphragms and end pipes, which are favourably matched from the efficiency standpoint.

The present invention therefore relates to high speed internal combustion engines used for driving tree saws, e.g. motor-driven chain saws and lawn mowers, as well as light motor cycles in which by optimised vibrational synchronization and matching of the intake and exhaust silencer in a very confined space on the one hand the output of the drive units is kept constant and on the other there is a highly effective damping of the sound transmitted by air. As a result, on internal combustion engines, which are in any case characterised by a very compact construction, the dominating parameters of engine building, namely noise, efficiency and constructional volume can be optimised. The invention therefore relates to the design and construction of intake and exhaust silencers, their synchronization with a view to reducing noise and maintaining performance and their coupling to the drive unit. The latter consideration of the overall system is particularly necessary for performance maintenance purposes.

The problem of the present invention is therefore to provide an apparatus for internal combustion engines with improved damping of the intake and/or exhaust noises, as compared with known apparatus.

According to the invention, this problem is solved by an apparatus for reducing intake and exhaust noise of the type described hereinbefore, which is constructed in such a way that the outlet of the exhaust gas supply pipe and the inlet of the exhaust gas discharge pipe are arranged facing one another in the casing, that the length of the exhaust gas supply pipe projecting into the casing is half the casing length and the length of the exhaust gas discharge pipe projecting into the casing is a quarter of the casing length and that the length of the gap between the two pipe connections is a quarter of the overall length.

According to a further solution of the problem, the apparatus for reducing the intake noise of the type described hereinbefore is characterised in that the casing is provided with an air intake connection whose one end extends into the inner area of the casing and with a carburettor connection whose one end extends into the inner area of the casing and whose inlet faces the outlet of the air intake connection located in the inner area of the casing accompanied by the formation of a space having a width approximately corresponding to half the diameter of the connection which has the same diameter.

According to a further solution of the problem in a casing three chambers are formed, whereof one chamber has the exhaust gas supply and is connected by means of a pipe connection to the second chamber, which is in turn connected by a pipe connection to the third chamber having a pipe connection projecting into the inner area of the chamber and connected to an exhaust gas discharge port formed in the casing wall. Of the three chambers of the casing, that connected to the exhaust gas supply is formed in the casing by a vertical partition connected with the casing wall facing the casing wall with the exhaust gas supply via a horizontal partition, accompanied by the formation of the upper chamber and the lower chamber.

According to a further solution of the problem in a box-like single and multi-chamber casing closed on all sides and with an exhaust gas inlet is provided an exhaust gas discharge pipe constructed as a pipe coil or pipe bend, whose one end is connected to the discharge port in the casing wall facing the casing wall with the exhaust gas inlet and whose other end located in the inner area of the casing and facing the exhaust gas inlet is closed and is located approximately in the exhaust gas inlet area located at quarter the chamber length has a plurality of slot-like openings distributed over its periphery.

Thus, an internal combustion engine constructed according to the proposals of the invention is characterised in that in the case of a corresponding design and synchronization of an intake and exhaust silencer system, there is an optimisation of the engine parameters, such as noise, performance and constructional volume. Unlike in the hitherto used silencer designs on the drive units of tree saws, lawn mowers and light motor cycles as a result of the construction of the various apparatus according to the invention intake and exhaust silencers are proposed in which, although known design criteria are employed, these reveal as a result of specific technical developments and manipulation based on this that effective sound reduction and insulation can be obtained in the minimum constructional space available.

On said dividing of the overall noise into partial noise sources for intake, exhaust and engine noise in internal combustion engines for motor-driven chain saws, lawn mowers and light motor cycles it has surprisingly been found that the intake noise is considerably reduced if the intake device is constructed according to the characterising parts of the claims. As a result of the construction of the apparatus according to the invention, a reduction of the sound pressure level is obtained, whilst maintaining the performance or output of the engine.

Further advantageous embodiments of the invention are apparent from the subclaims.

The invention is described in greater detail hereinafter relative to embodiments and the attached drawings, wherein show:

FIG. 1 a diagrammatic view illustrating the design principle for reducing the intake and exhaust noise on internal combustion engines with a casing with pipe connections extending into its inner area.

Figure 2:
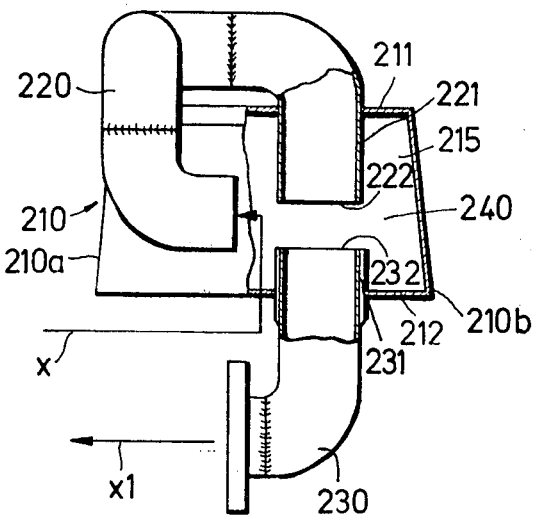

FIG. 2 an apparatus for reducing the intake noise, partly in elevation and partly in vertical section.

Figure 3:
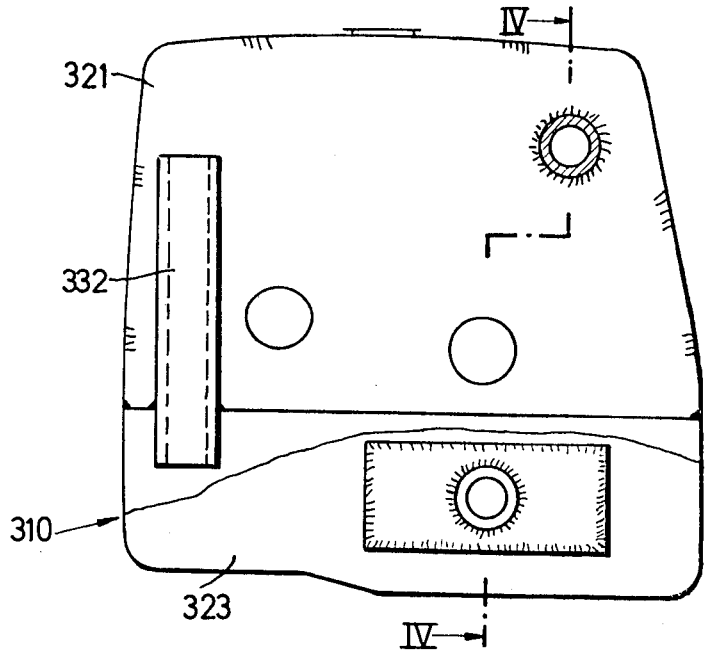

FIG. 3 an apparatus for reducing the exhaust noise with a three chamber casing, partly in elevation and partly in vertical section.

Figure 4:
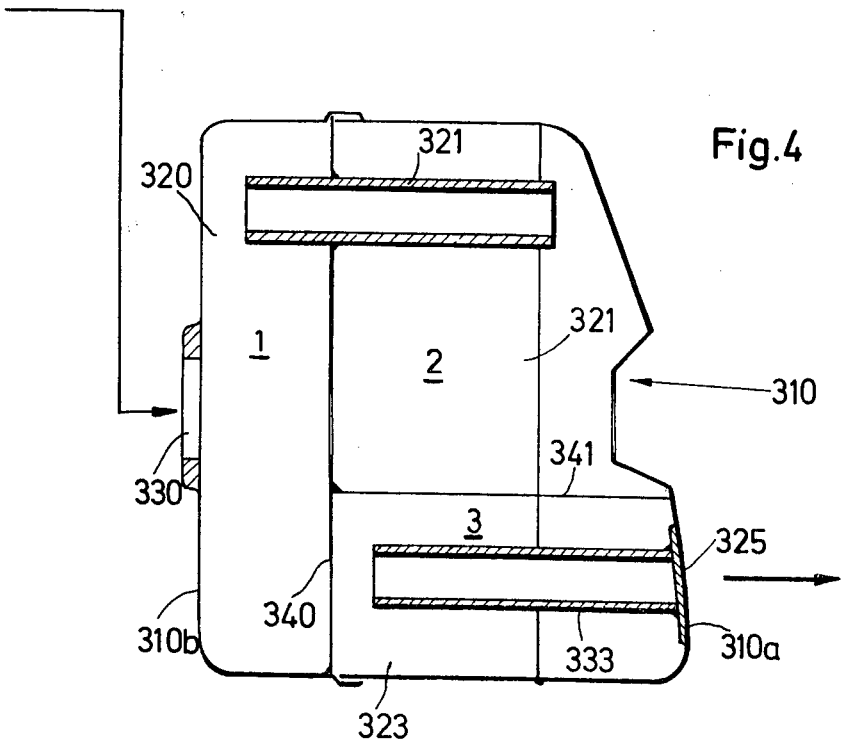

FIG. 4 a vertical section along the line IV—IV of FIG. 3.

Figure 5:
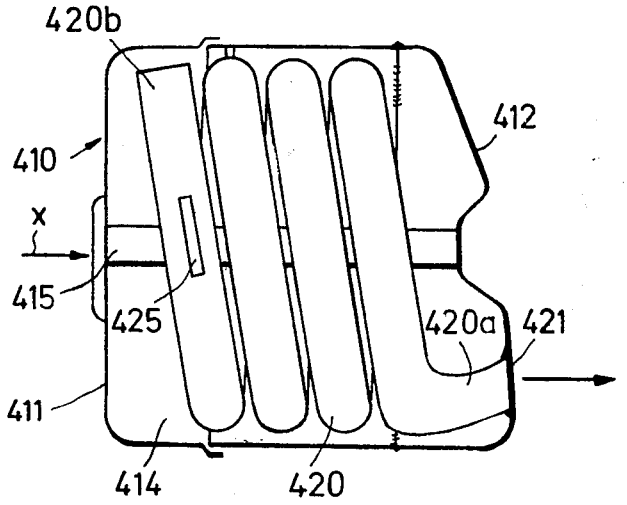

FIG. 5 an apparatus provided with a pipe coil for reducing exhaust noise partly in elevation and partly in vertical section.

Figure 6:
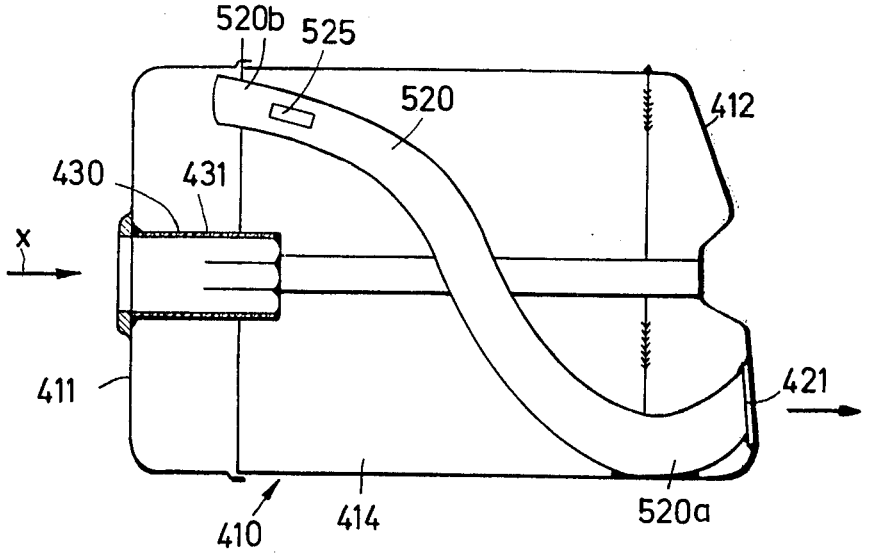

FIG. 6 a further embodiment of the apparatus for reducing the exhaust noise with a partly spiral exhaust gas discharge pipe, partly in side view and partly in vertical section.

FIG. 1 shows a single chamber resonator for illustrating the design principle used in preferred manner on the intake silencer according to FIG. 2. In FIG. 1, 10 is a closed box-like casing, into whose inner area project an exhaust gas supply pipe 11 and an exhaust gas discharge pipe 12 said pipes being arranged in the inner area of casing 10 in such a way that the outlet 11*a* of exhaust gas supply pipe 11 faces the inlet 12*a* of the exhaust gas discharge pipe 12, a gap 15 being formed between output 11*a* and inlet 12*a*.

The line system shown in FIG. 1 serves to reduce chamber resonances. The exhaust gas supply pipe issues into the pressure node of the fundamental wave. As the large source impedance of the exhaust gas discharge pipe 11 does not allow at this point favourable adaptation conditions to the low chamber impedance the fundamental wave is only slightly excited, whereas the first harmonic is greatly excited. To prevent transmission into the exhaust gas discharge pipe 12 the latter is arranged in the inner area of casing 10 in such a way that it issues into the pressure node of the first harmonic. The chamber resonances are avoided through the length of the exhaust gas supply pipe 11 projecting into the inner area of casing 10 being half the casing length and the length of the exhaust gas discharge pipe 12 projecting into casing 10 being quarter of the casing length. The remaining length of gap 15 between the two pipe connections 11 and 12 also corresponds to quarter the casing length.

To prevent the formation of standing waves within the resonator volume in the case of the intake silencer shown in FIG. 2 the lateral casing walls 210*a* and 210*b* of the intake silencer are slightly inclined towards one another instead of being parallel.

The intake silencer shown in FIG. 2 comprises a box-like casing 210 closed on all sides with an upper cover plate 211 and a base plate 212, which as resonator surfaces are sound-insulated in per se known manner. The inner area of casing 210 is indicated at 215.

Casing 210 has an air intake connection 220 via which air is drawn in in the direction of arrow X and a connection 230 via which a supply takes place to the carburettor of the internal combustion engine, for example of, a motor-driven chain saw which is not shown in the drawing. One end 221 on the air intake connection 220 extends into the inner area 215 of the casing, whilst the air discharge port in the inner area 215 of the casing 210 is indicated by reference numeral 222.

One end 231 of the carburettor connection 230 also extends into the inner area 215 of the casing 210 in such a way that its inlet 232 faces the outlet 222 of the air intake connection 220, accompanied by the formation of a space 240. The air flowing through casing 210 is supplied to the carburettor in the direction of arrow X1 via connection 230. The width of space 240 between inlet 232 of connection 230 and outlet 222 of the air intake connection 220 approximately corresponds to half the diameter of the connections 220 and 230 which have the same diameter. It has surprisingly been found that the best noise damping is obtained if the width of space 240 approximately corresponds to 12.5 mm in the case of a connection diameter of 20 mm. The width of the space is understood to mean the distance between the outlet 222 of air intake connection 220 and inlet 232 of connection 230. Both connections 220 and 230 are constructed as pipe sockets with a circular diameter.

The length of the end 231 of the carburettor connection 230 projecting into the inner area 215 of casing 210 approximately corresponds to the width of space 240 between outlet 222 of air intake connection 220 and inlet 232 of carburettor connection 230.

The silencer according to FIGS. 3 and 4 comprises a casing 310 in which are formed three chambers 320, 321 and 323. The exhaust gas supply 330 is provided in casing side wall 310*b*, whilst the exhaust gas discharge port 325 is provided on the facing side wall 310*a*.

Of the three chambers, 320, 321, 323, chamber 320 is formed by a vertical partition 340 located in the inner area of casing 310. A further horizontal partition 341 connecting the partition 340 with the casing side wall 310*a* subdivides the remaining chamber into the upper chamber 321 and a lower chamber 323. The two chambers 320 and 321 are interconnected by a pipe connection 331. A further pipe connection 332 is provided and once again interconnects the two chambers 321 and 323. Lower chamber 323 contains a pipe connection 333 connected to the exhaust gas discharge port 325 and extending into the inner area of chamber 323. In this three chamber silencer chambers 320, 321 and 323 are of different size.

The exhaust silencer according to FIG. 5 also comprises a box-like casing 410, closed on all sides and with a front wall 411 and a rear wall 412. The front wall 411 of casing 410 contains an exhaust gas inlet 415 to which can be connected a pipe connection 430 projecting into the inner area 414 of casing 410 and which is closed in its rear area and has openings 431 distributed over its periphery. Exhaust gases pass into casing 410 through inlet 415 in the direction of arrow X.

In casing 410, a pipe coil 420 is arranged in such a way that its one end 420*a* is connected to an outlet 421 in rear wall 412 of the casing, whilst the other end 420*b* of the pipe coil is located in the vicinity of front wall 411 and is closed at the end. In the exhaust gas inlet area, the pipe coil end portion has a plurality of slot-like openings 425 distributed over its periphery and which serve as inlets for the exhaust gases to be passed through the pipe coil 420 and which flow into casing 410 via the exhaust gas inlet 415. There are advantageously four slot-like openings in the pipe end area 420*b* or 520*b*.

In the case of the embodiment shown in FIG. 6, a pipe bend 520 is provided as the exhaust gas discharge pipe in the inner area 414 of inner casing 410. The shape of pipe bend 520 corresponds to that of a portion of a coil. End 520*a* of discharge pipe 520 is connected to the outlet 421 in casing rear wall 412, whilst the other end 520*b* of the exhaust gas discharge pipe is closed and provided with slot-like openings 525.

As a result of this apparatus or exhaust silencer low inherent frequencies are obtained, so that e.g. a rated engine frequency of 125 Hz is covered by the damping range of the silencer acting as a resonator. These low inherent frequencies are obtained in the embodiment of FIG. 5 by increasing the pipe length and in the embodiment of FIG. 6 by increasing the casing volume. Sound-insulated plates are used for the silencer casing.

We claim:

1. Apparatus for reducing the intake noise of high-speed internal combustion engines, such as for internal combustion engine-driven chain saws, lawn mowers and light motor cycles, comprising a closed, box-like casing, characterized in that the casing (210) encloses an inner space and is provided with an air intake connection (220) whose outlet end (221) extends through said casing into the inner space (215) of the casing (210) and a carburetor connection (230) whose inlet end (231) extends through the opposite side of said casing into the inner space (215) of the casing (210) and said inlet end (232) faces and is spaced from the outlet end (222) of the air intake connection located in the inner area (215) of the casing (210) accompanied by the formation of a gap therebetween (240) having a dimension in the axial direction of said air intake connection and carburetor connection within said housing corresponding to the range of 50 to 75% of the diameter of the connections (220,230) which have the same diameter.

2. Apparatus according to claim 1, characterized in that the inlet end (231) of the carburetor connection (230) projecting into the inner area (215) of casing (210) has a length corresponding to the axial dimension of said gap (240).

3. Apparatus according to claims 1 or 2 characterized in that said casing having facing side walls (**210*a*, 210*b***) extending in the axial direction of said air intake and carburetor connections are slightly inclined towards one another in the direction from said carburetor connection toward said air intake connection.

4. Apparatus for reducing at least one of the intake and exhaust noises of high-speed internal combustion engines, such as for internal combustion engine-driven chain saws, lawn mowers and light motor cycles, comprising a wall forming a closed, box-like chamber casing with a gas supply pipe and a gas discharge pipe, characterized in that the outlet of said gas supply pipe and the inlet of said gas discharge pipe extend into said casing and are arranged inwardly from the walls of said casing in spaced apart relation and in substantially axial alignment with a gap extending therebetween, said supply pipe to said outlet thereof and said discharge pipe to said inlet thereof extending into said casing extend generally in the direction of the one of said walls of said casing so that the length of sid gas supply pipe projecting into said casing is a first portion of the dimension of the one of said walls in which direction said supply pipe and discharge pipe extend and the length of the gas discharge pipe projecting into the casing is a second portion of the dimension of the one of said walls in which direction said supply pipe and discharge pipe extend and the dimension of the gap between the outlet of said supply pipe and the inlet of said discharge pipe is a third portion of the dimension of the one of said walls in which direction said supply pipe and discharge pipe extend whereby said first, second and third portions equal the total dimension of the one of said walls in which direction said supply pipe and discharge pipe extend, and the dimension of said third portion is one of a quarter of the overall dimension of the one of said walls in which direction said supply pipe and discharge pipe extend and in the range of 50 to 75% of the diameter of said supply pipe and discharge pipe, said pipes being of the same diameter.

* * * * *